US007663542B1

(12) United States Patent
Goodzeit et al.

(10) Patent No.: US 7,663,542 B1
(45) Date of Patent: Feb. 16, 2010

(54) ANTENNA AUTOTRACK CONTROL SYSTEM FOR PRECISION SPOT BEAM POINTING CONTROL

(75) Inventors: Neil E. Goodzeit, Princeton, NJ (US); Harald J. Weigl, Doylestown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 153 days.

(21) Appl. No.: 10/980,305

(22) Filed: Nov. 4, 2004

(51) Int. Cl.
*H01Q 3/00* (2006.01)

(52) U.S. Cl. ..... 342/359

(58) Field of Classification Search ..... 342/73–77, 342/350, 352, 354, 359, 385–386, 417, 420
See application file for complete search history.

(56) References Cited

U.S. PATENT DOCUMENTS 4,883,244 A * 11/1989 Challoner et al. ..... 244/171
5,043,737 A * 8/1991 Dell-Imagine ..... 342/358
5,062,592 A * 11/1991 Kishimoto ..... 244/164
5,184,139 A * 2/1993 Hirako et al. ..... 342/354
5,341,147 A * 8/1994 Scott ..... 342/360
5,374,933 A * 12/1994 Kao ..... 342/357.13
5,521,604 A * 5/1996 Yamashita ..... 342/359
5,587,714 A * 12/1996 Chu et al. ..... 342/354
5,838,278 A * 11/1998 Tsujisawa et al. ..... 342/377
5,940,034 A * 8/1999 Leung ..... 342/380
6,329,947 B2 * 12/2001 Smith ..... 342/418
6,538,602 B2 * 3/2003 Natsume et al. ..... 342/359
6,595,469 B2 * 7/2003 Li et al. ..... 244/158.1
6,704,607 B2 * 3/2004 Stone et al. ..... 700/56
6,720,918 B2 * 4/2004 Reckdahl et al. ..... 342/358
6,961,016 B1 * 11/2005 Pozgay ..... 342/77
7,015,857 B1 * 3/2006 Pozgay ..... 342/174
7,053,828 B1 * 5/2006 Goodzeit et al. ..... 342/359
7,174,242 B2 * 2/2007 Deakin ..... 701/21
2005/0007273 A1 * 1/2005 Fowell et al. ..... 342/359

* cited by examiner

*Primary Examiner*—Thomas G Black
*Assistant Examiner*—Shelley Chen
(74) *Attorney, Agent, or Firm*—McDermott Will & Emery LLP

(57) ABSTRACT

The present invention provides a system and a method for improving spacecraft antenna pointing accuracy utilizing feedforward estimation. The present invention takes advantage of the fact that spacecraft antenna pointing error has periodic behavior with a period of 24 hours. Thus, unlike the prior art feedback systems which blindly correct antenna pointing error continuously reacting only to presently sensed error, the present invention takes an intelligent approach and learns the periodic behavior of spacecraft antenna pointing error. Then, an estimate of antenna pointing error at a particular time going forward is predicted based on the learned model of the periodic behavior of the antenna pointing error. The predicted estimate is then used to correct or cancel out the antenna pointing error at a particular time in the future. The result is more accurate correction of spacecraft antenna pointing error by more than a factor of two.

12 Claims, 4 Drawing Sheets

ANTENNA AUTOTRACK CONTROL SYSTEM FOR PRECISION SPOT BEAM POINTING CONTROL

STATEMENT AS TO RIGHTS TO INVENTIONS MADE UNDER FEDERALLY SPONSORED RESEARCH OR DEVELOPMENT

Not Applicable.

BACKGROUND OF THE INVENTION

1. Field of the Invention

The present invention relates generally to spacecraft antenna pointing error correction, and specifically to a system and a method for improving spacecraft antenna pointing accuracy utilizing feedforward estimation.

2. Description of the Related Art

A significant trend in satellite communications is the use of spot beams to provide targeted services to specific urban regions and population centers. Examples of A2100 spacecraft that include spot beam payloads are Echostar 7, Rainbow-1, and the Echostar X spacecraft. Given the typical small coverage region diameter of 200 to 400 km, accurate pointing is critical to minimize the necessary beam diameter and payload power. To achieve high accuracy beam pointing, prior art systems use autotrack antenna feeds and receivers that sense the antenna pointing error with respect to an uplink beacon signal. With an autotrack system, antenna circular pointing errors of 0.05 degrees are possible, which is a factor of three better than the typical 0.15 degree pointing error without autotrack. The drawback of prior-art autotrack systems is that they use feedback control strategies that react only to the presently sensed pointing error. When the error exceeds a given threshold, the antenna gimbal is stepped to reduce the error.

Typically, the threshold is set to a value of one gimbal step, so the tracking error will be at least this much and generally more due to latencies in the system implementation. For example, for a step size of 0.012 degrees, the maximum pointing error is roughly 0.02 degrees using a prior-art control approach. This error is excessive, since it represents 40% of the total allowable pointing error of 0.05 degrees due to all sources. Lowering the threshold can reduce the error, but also may cause excessive stepping due to noise that can exceed the gimbal mechanism life capability over the 15 year mission.

SUMMARY OF THE INVENTION

The system according to the invention provides improved performance by taking advantage of the fact that the antenna pointing error is periodic at the spacecraft orbit period of 24 hours. Therefore, it is possible to estimate the periodic antenna pointing error using an adaptive or fixed gain estimator and step the antenna gimbal to cancel it before a significant error in antenna pointing actually accrues. The estimator is designed to capture the significant harmonic components of the error signal and to reject the measurement noise, thereby preventing excessive gimbal stepping. Using an adaptive feedforward approach according to the invention, the antenna pointing error may be reduced to roughly half a gimbal step, or 0.006 degrees. This results in an improvement of 0.01 degrees in total antenna pointing, which may have a significant impact on mission performance. For example, for a 0.5 deg diameter spot beam, reducing the pointing error from 0.05 to 0.04 degrees would allow the payload power to be reduced by 7% (by shrinking the beam size), or alternatively would allow the service area to be increased by 10% (without changing the beam size).

According to one aspect of the invention, the present invention is a system for improving spacecraft antenna pointing accuracy including an antenna pointing error detection module for detecting and measuring spacecraft antenna pointing error, a feedforward estimator module for learning spacecraft antenna pointing error behavior from the measured spacecraft antenna pointing error and generating predictive output of estimated future spacecraft antenna pointing error, and an antenna pointing error correction module for prospectively correcting spacecraft antenna pointing error based on the predictive output from the feedforward estimator module.

According to another aspect of the invention, the present invention is a method for improving spacecraft antenna pointing accuracy including detecting and measuring spacecraft antenna pointing error, providing the measured spacecraft antenna pointing error as input to a feedforward estimator module, the feedforward estimator module learning spacecraft antenna pointing error behavior from the measured spacecraft antenna pointing error input, the feedforward estimator module generating predictive output of estimated future spacecraft antenna pointing error based on the measured spacecraft antenna pointing error input, and prospectively correcting spacecraft antenna pointing error based on the predictive output from the feedforward estimator module.

According to yet another aspect of the invention, the present invention is a system for improving spacecraft antenna pointing accuracy including means for detecting and measuring spacecraft antenna pointing error, means for providing the measured spacecraft antenna pointing error as input to a feedforward estimator module, means for the feedforward estimator module learning spacecraft antenna pointing error behavior from the measured spacecraft antenna pointing error input, means for the feedforward estimator module generating predictive output of estimated future spacecraft antenna pointing error based on the measured spacecraft antenna pointing error input, and means for prospectively correcting spacecraft antenna pointing error based on the predictive output from the feedforward estimator module.

Other and further objects and advantages of the present invention will be further understood and appreciated by those skilled in the art by reference to the following specification, claims, and drawings.

BRIEF DESCRIPTION OF THE DRAWINGS

Referring now to the drawings in which like reference numbers represent corresponding parts throughout.

DETAILED DESCRIPTION OF THE INVENTION

Figure 1:
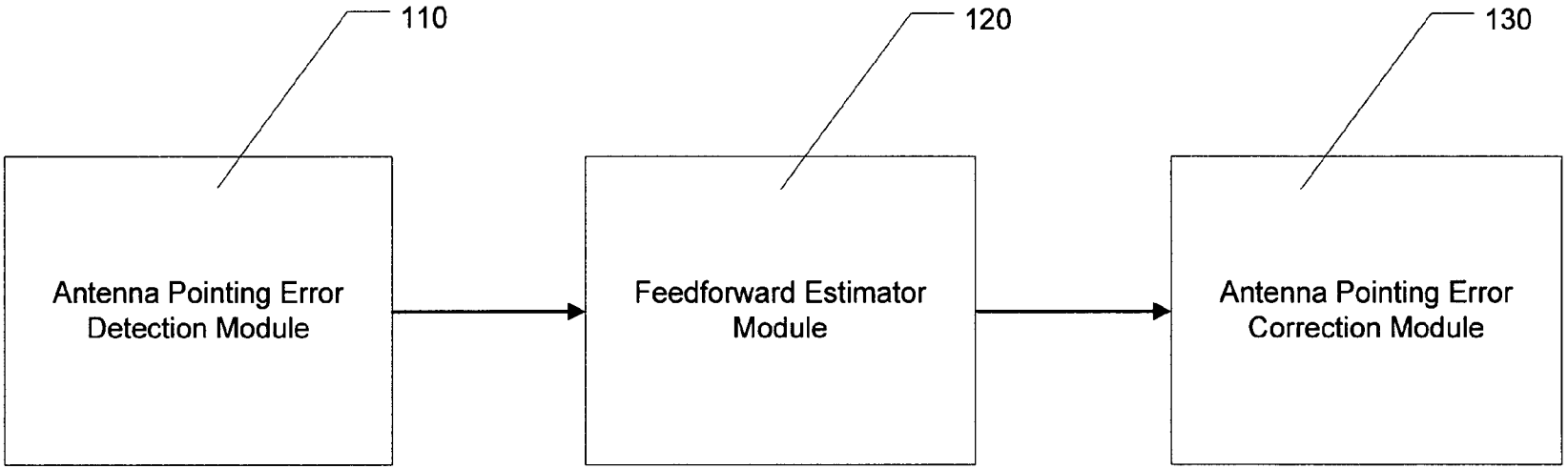
FIG. 1 illustrates a block diagram for a system for improving spacecraft antenna pointing accuracy according to the present invention.

FIG. 1 illustrates a block diagram for a system for improving spacecraft antenna pointing accuracy according to the present invention. As shown in FIG. 1, the system according to the present invention comprises antenna pointing detection module (110) for detecting and measuring spacecraft antenna pointing error, feedforward estimator module (120) for learning spacecraft antenna pointing error behavior from the measured spacecraft antenna pointing error and generating a predictive output of estimated future spacecraft antenna pointing error, and antenna pointing error correction module (130) for prospectively correcting spacecraft antenna pointing error based on the predictive output from the feedforward estimator module.

In contrast to the prior-art feedback control approaches, the present invention takes advantage of the periodic nature of spacecraft antenna pointing error behavior which has the period of 24 hours. As well known to those skilled in the art, the spacecraft antenna pointing error has a pattern that repeats itself every 24 hours due to the fact that the spacecraft orbits Earth with a period of 24 hours. Hence, instead of blindly correcting antenna pointing error continuously as done in the prior art feedback control systems, the present invention learns or models the periodic antenna pointing error behavior with a functional model of the measured antenna pointing error values. Then, an estimate of future antenna pointing error is predicted from the learned antenna pointing error behavior model, which is in turn used to prospectively correct antenna pointing error—i.e., correct the antenna pointing error at a future point in time by canceling out the predicted pointing error amount. Such use of feedforward estimator according to the present invention is novel for spacecraft antenna pointing error correction systems.

Figure 2:
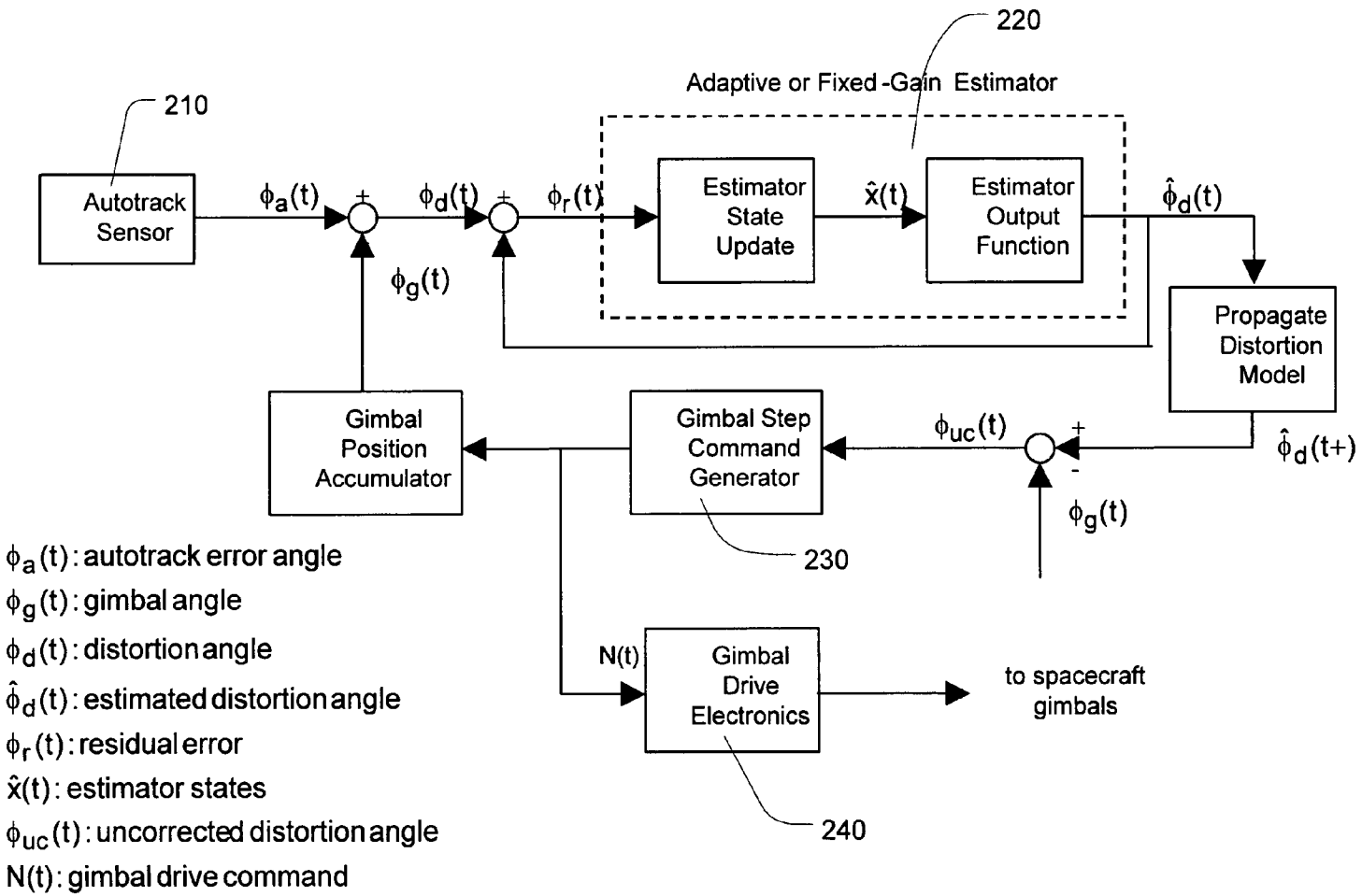
FIG. 2 illustrates a preferred embodiment of the system according to the present invention.

FIG. 2 illustrates a preferred embodiment of the system according to the present invention. Shown in FIG. 2 is a continuous-time implementation of a spacecraft antenna autotrack system with feedforward compensation of periodic antenna pointing errors according to the present invention.

Autotrack sensor (210) measures the error between the actual antenna boresight pointing direction and the line of sight vector to an uplinked beacon signal source. This error is added to the antenna gimbal angle to determine the total antenna distortion angle as shown in Equation 1.

$$\phi_d(t)=\phi_a(t)+\phi_g(t) \tag{1}$$

Under the assumption that the antenna distortion is periodic, estimator (220) is used to model the distortion. The estimator input is the measured distortion angle and the output is the estimated distortion angle. The difference between the measured and estimated distortion angle is the residual error as computed in Equation 2.

$$\phi_r(t)=\phi_d(t)-\hat{\phi}_d(t) \tag{2}$$

This residual is used to update the estimator coefficients in order to improve the model accuracy. The update algorithm may be the standard Recursive Least Squares (RLS) algorithm that is known to those with skill in the art. For on-board implementations, computationally efficient mechanization of the RLS algorithm are known, such as the Fast Transversal Filter (FTF). However, any optimization algorithm or technique known to those skilled in the art can be used to update the estimator coefficients without departing from the scope of the present invention. The updated model coefficients are used to compute the estimated distortion angle at the next time step, denoted as $\hat{\phi}_d(t+)$. The current gimbal angle is then subtracted from this estimated future distortion angle in order to compute the uncorrected distortion expected at the next time step:

$$\phi_{uc}(t+)=\hat{\phi}_d(t+)-\phi_g(t) \tag{3}$$

Based on the uncorrected distortion angle, the gimbal step command generator (230) computes the number of gimbal steps required to reduce the distortion angle to less than half a gimbal step. The gimbal steps are commanded to gimbal drive electronics (240) and the total gimbal angle is updated accordingly. It should be noted that the gimbal angle correction may be computed based on the uncorrected distortion angle in Equation 3, or it may be computed based on both the present and future (one step ahead) uncorrected error estimates. The correction may be computed to minimize the pointing error over the pointing correction update interval (typically 5 or 6 minutes).

As noted in FIG. 2, distortion angle estimator (220) may be implemented as a time varying adaptive or fixed-gain filter without departing from the scope of the present invention. An underlying model or functional basis is chosen that provides accurate modeling of the actual distortion angle. Modeling of antenna pointing error behavior can be accomplished utilizing any functional modeling technique known to those skilled in the art, including, but not limited to, temporal Fourier series, wavelets, temperature measurements, and an autoregressive (AR) model, without departing from the scope of the present invention.

The AR model is a particularly good one, because the actual frequencies contained in the distortion angle may not be known in advance, and a sufficiently high order model will capture all frequency components that are present. Furthermore, as is known to those with skill in the art, over-parameterizing the model (increasing the model order above what is strictly required to model the distortion angle) provides noise attenuation that prevents excessive gimbal stepping.

In one embodiment of the invention, the periodic distortion is modeled using a $p^{th}$ order discrete-time AR model of the following form:

$$\phi_d[k]=a_1\phi_d[k-1]+a_2\phi_d[k-2]+\ldots a_p\phi_d[k-p] \tag{4}$$

where $\phi_d[k]$ is the current distortion angle. The model coefficients $(a_1, a_2, \ldots a_p)$ are computed using an RLS filter in this embodiment. The future distortion is then computed based on measurements $(\phi_d[k], \phi_d[k-1], \ldots \phi_d[k-p+1])$.

Viewed in another way, feedforward estimator is a machine learning system that learns the functional behavior of a function from a set of known values or measurements—i.e., past measurements—and predicts the future behavior of the function—i.e., gives an estimate of the functional behavior at a point in the future—hence the name feedforward. According to the present invention, feedforward estimator (220) can utilize any machine learning technologies known to those skilled in the art, including, but not limited to, the neural networks, the genetic algorithms, Kalman filters, and Bayesian learning systems.

The processing or computation for feedforward estimator (220) can be performed on-board the spacecraft with a choice of appropriate computing model, software, and hardware. However, the processing can also be performed at a ground station without departing from the scope of the present invention. In this embodiment, the choice of computing model, software, and hardware is much greater, as a ground station can provide much greater range of computing resources than the spacecraft on-board modules.

Figures 3, 4, 5:
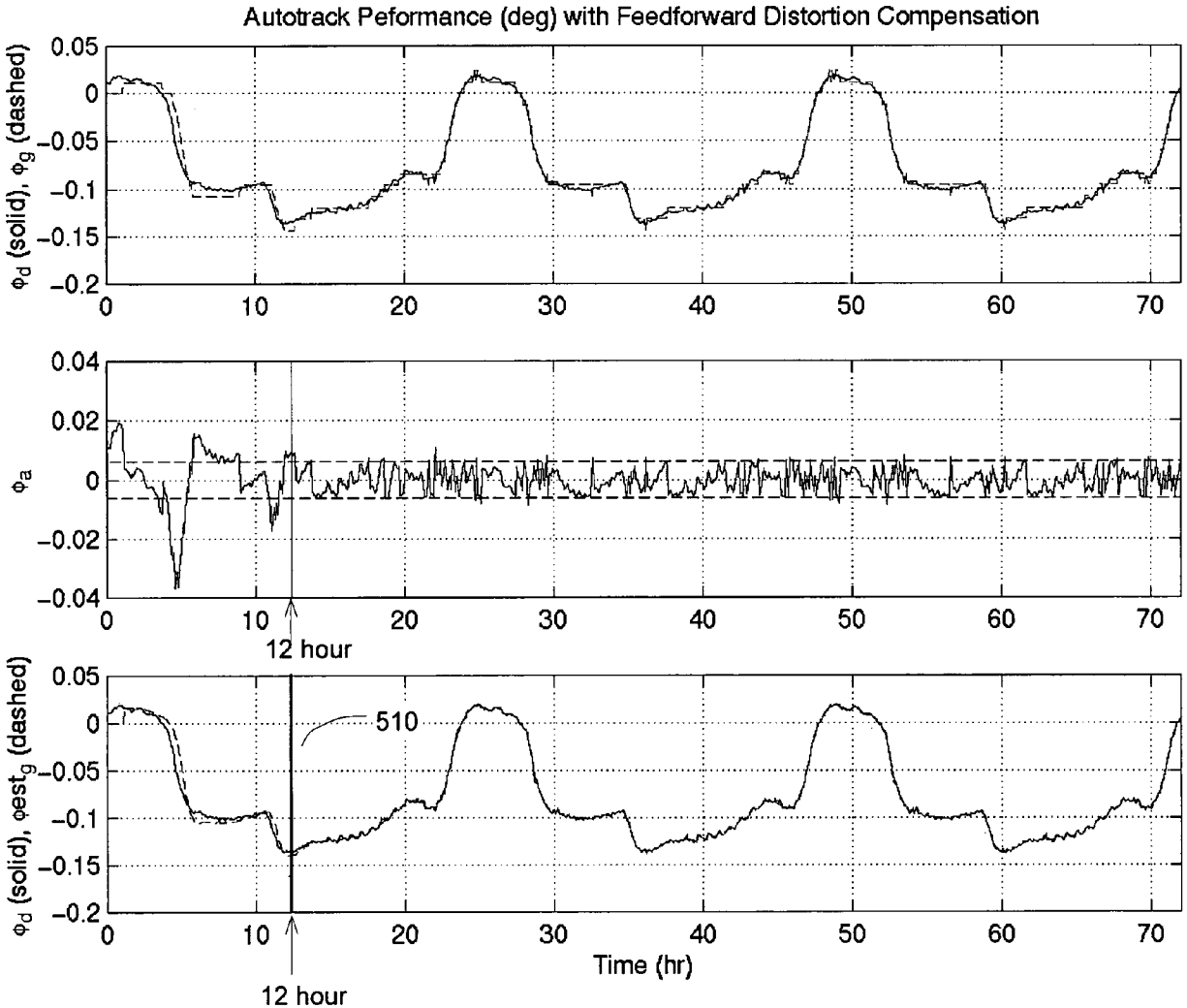
FIG. 3 (Prior Art)
FIG. 3 shows the actual spacecraft antenna distortion angle and the antenna gimbal angle.
FIG. 4 illustrates the residual antenna pointing error according to the present invention.
FIG. 5 shows the agreement between the actual distortion angle and the estimated distortion angle according to the present invention.

FIG. 3, FIG. 4, and FIG. 5 show the simulated performance of an autotrack control system according to the present invention. The estimator design includes a $10^{th}$ order AR model, and a 6 minute update interval. FIG. 3 shows the actual spacecraft antenna distortion angle and the antenna gimbal angle. As can be seen from FIG. 3, spacecraft antenna pointing error—i.e., the distortion angles—has a periodic pattern with a period of 24 hours.

FIG. 4 illustrates the residual antenna pointing error according to the present invention. FIG. 4 shows that in steady state the residual antenna pointing error is within roughly one-half a gimbal step (0.006 degrees). FIG. 5 shows the agreement between the actual distortion angle and the estimated distortion angle according to the present invention. As shown in FIG. 5, once the estimated distortion model has converged after roughly 12 hours—note the 12 hour line (510)—the estimated distortion angle agrees closely with the actual distortion angle.

Figure 6:
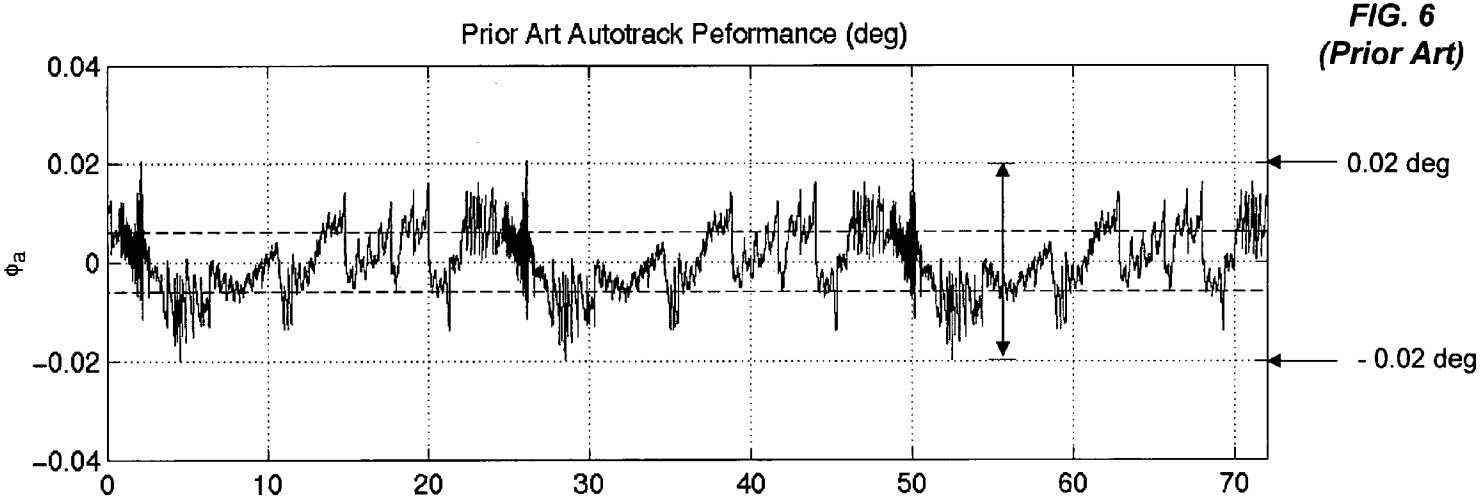
FIG. 6 (Prior Art)
FIG. 6 shows the autotrack performance of the prior art feedback control system.
Figure 7:
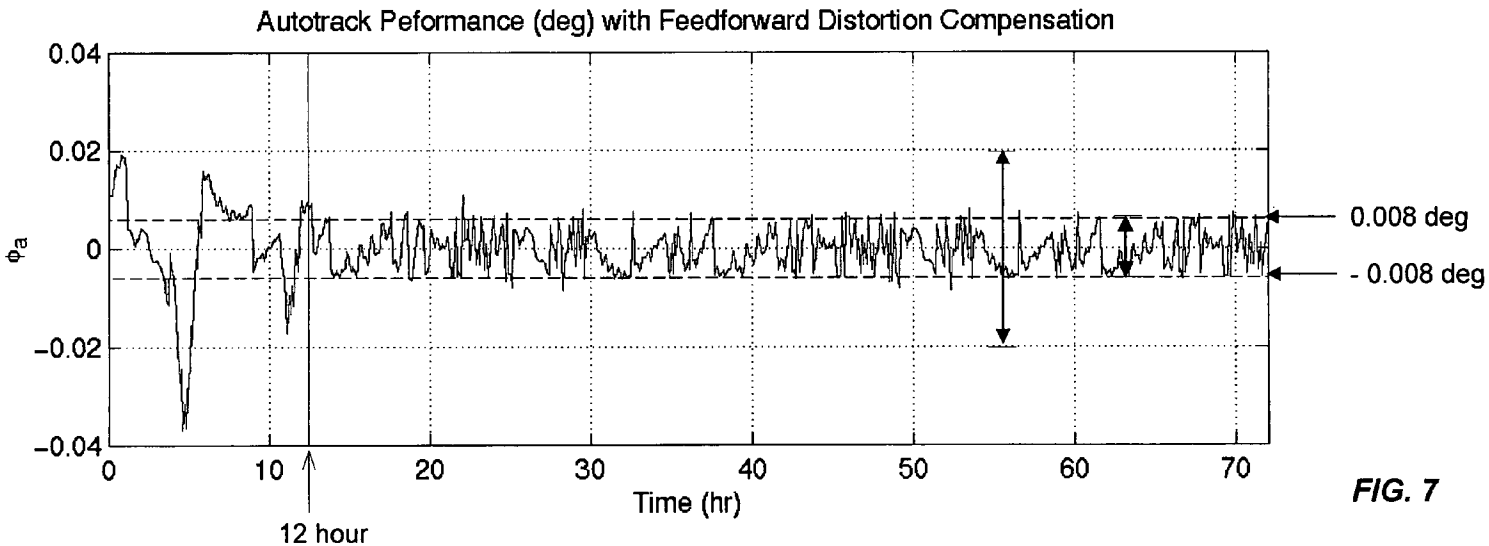
FIG. 7 shows the autotrack performance with feedforward estimator compensation according to the present invention.

FIG. 6 and FIG. 7 compare the performance of the prior-art control approach with a system according to the invention. The distortion angle profile is the one shown in FIG. 3. FIG. 6 shows the autotrack performance of the prior art feedback control system. As shown in FIG. 6, the peak tracking error for the prior art system is roughly 0.02 degrees. FIG. 7 shows the autotrack performance with feedforward estimator compensation according to the present invention. As shown in FIG. 7, the peak steady state tracking error for the system according to the invention is roughly 0.008 degrees, which is more than a factor of two improvement over the prior-art system.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A closed-loop system for improving spacecraft antenna pointing accuracy, comprising:

an antenna pointing error detection module for detecting and measuring spacecraft antenna pointing error;

an adaptive feedforward estimator module for learning spacecraft antenna pointing error behavior from currently measured spacecraft antenna pointing error, and for concurrently generating predictive output of estimated future spacecraft antenna pointing error, the feedforward estimator module utilizing an autoregressive model given by $\phi_d[k]=a_1\phi_d[k-1]+a_2\phi_d[k-2]+\ldots+a_p\phi_d[k-p]$, where $\phi_d[k]$ is current distortion angle, and $\phi_d[k-1]$, $\phi_d[k-2]$, and $\phi_d[k-p]$ are previously measured distortion angles, the autoregressive model being a discrete-time non-Fourier model; and an antenna pointing error correction module for prospectively correcting spacecraft antenna pointing error based on the predictive output from the feedforward estimator module.

2. The system of claim 1, wherein the antenna pointing error detection module is an autotrack sensor that measures error between an antenna boresight pointing direction and a line of sight vector to an uplinked beacon signal source.

3. The system of claim 1, wherein processing for the feedforward estimator module is performed onboard the spacecraft.

4. The system of claim 1, wherein processing for the feedforward estimator module is performed at a ground station.

5. The system of claim 1, wherein the antenna pointing error correction module prospectively corrects the spacecraft antenna pointing error by outputting a gimbal step command to step at least one antenna gimbal based on the predictive output from the feedforward estimator module.

6. A method for improving spacecraft antenna pointing accuracy, comprising the steps of:

detecting and measuring spacecraft antenna pointing error;

providing the measured spacecraft antenna pointing error as input to an adaptive feedforward estimator module;

the feedforward estimator module learning spacecraft antenna pointing error behavior from currently measured spacecraft antenna pointing error input, the feedforward estimator module utilizing an autoregressive model given by $\phi_d[k]=a_1\phi_d[k-1]+a_2\phi_d[k-2]+\ldots+a_p\phi_d[k-p]$, where $\phi_d[k]$ is current distortion angle, and $\phi_d[k-1]$, $\phi_d[k-2]$, and $\phi_d[k-p]$ are previously measured distortion angles, the autoregressive model being a discrete-time non-Fourier model;

the feedforward estimator module generating predictive output of estimated future spacecraft antenna pointing error based on the measured spacecraft antenna pointing error input and concurrently with the feedforward estimator module learning spacecraft antenna pointing error behavior; and prospectively correcting spacecraft antenna pointing error based on the predictive output from the feedforward estimator module.

7. The method of claim 6, wherein the antenna pointing error detection module is an autotrack sensor that measures error between an antenna boresight pointing direction and a line of sight vector to an uplinked beacon signal source.

8. The method of claim 6, wherein processing for the feedforward estimator module is performed onboard the spacecraft.

9. The method of claim 6, wherein processing for the feedforward estimator module is performed at a ground station.

10. The method of claim 6, wherein:

in the step of detecting and measuring spacecraft antenna pointing error, the measured spacecraft antenna pointing error is total distortion angle, $\phi_d(t)$ which is given by:

$\phi_d(t)=\phi_a(t)+\phi_g(t)$, where $\phi_a(t)$ is autotrack error angle and $\phi_g(t)$ is gimbal angle; and in the step of the feedforward estimator module generating predictive output of estimated future spacecraft antenna pointing error, the predictive output is estimated future distortion angle given by:

$\phi_d[k+1]=a_1\phi_d[k]+a_2\phi_d[k-1]+\ldots a_p\phi_d[k-p+1]$, where $\phi_d[k+1]$ is the estimated future distortion angle, and $\phi_d[k]$, $\phi_d[k-1]$, and $\phi_d[k-p+1]$ are previously measured distortion angles.

11. The method of claim 6, wherein the spacecraft antenna pointing error is prospectively corrected by outputting a gimbal step command to step at least one antenna gimbal based on the predictive output from the feedforward estimator module.

12. A closed-loop system for improving spacecraft antenna pointing accuracy, comprising:

means for detecting and measuring spacecraft antenna pointing error;

means for providing the measured spacecraft antenna pointing error as input to an adaptive feedforward estimator module;

means for the feedforward estimator module learning spacecraft antenna pointing error behavior from currently measured spacecraft antenna pointing error input, the feedforward estimator module utilizing an autoregressive model given by $\phi_d[k]=a_1\phi_d[k-1]+a_2\phi_d[k-2]+\ldots+a_p\phi_d[k-p]$, where $\phi_d[k]$ is current distortion angle, and $\phi_d[k-1]$, $\phi_d[k-2]$, and $\phi_d[k-p]$ are previously measured distortion angles, the autoregressive model being a discrete-time non-Fourier model;

means for the feedforward estimator module generating predictive output of estimated future spacecraft antenna pointing error based on the measured spacecraft antenna pointing error input and concurrently with the feedforward estimator module learning spacecraft antenna pointing error behavior; and means for prospectively correcting spacecraft antenna pointing error based on the predictive output from the feedforward estimator module.

* * * * *